US007788736B2

(12) United States Patent
Gollin

(10) Patent No.: US 7,788,736 B2
(45) Date of Patent: Sep. 7, 2010

(54) ITEM OF CLOTHING SUCH AS A LIGHT JACKET, HEAVY JACKET, SPORTS JACKET OR THE LIKE

(75) Inventor: Fabrizio Gollin, Castelfranco Veneto (IT)

(73) Assignee: Prime S.R.L., Montebelluna (IT)

( * ) Notice: Subject to any disclaimer, the term of this patent is extended or adjusted under 35 U.S.C. 154(b) by 0 days.

(21) Appl. No.: 11/979,859

(22) Filed: Nov. 9, 2007

(65) Prior Publication Data

US 2008/0120769 A1 May 29, 2008

(30) Foreign Application Priority Data

Nov. 23, 2006 (IT) ..... PD2006A0438

(51) Int. Cl.
*A41D 1/00* (2006.01)

(52) U.S. Cl. ..... 2/94; 2/467; 2/85

(58) Field of Classification Search ..... 2/80, 2/84, 85, 86, 93, 94, 108, 115, 301, 467; 224/153; 602/19
See application file for complete search history.

(56) References Cited

U.S. PATENT DOCUMENTS

| | | | | |
|---|---|---|---|---|
| 2,165,348 | A * | 7/1939 | Daiber | 2/94 |
| 4,502,155 | A | 3/1985 | Itoi | |
| 4,563,777 | A * | 1/1986 | Park | 2/108 |
| 4,669,127 | A * | 6/1987 | Swanson | 2/46 |
| 4,689,831 | A * | 9/1987 | Greenberger et al. | 2/93 |
| 5,022,092 | A | 6/1991 | Bombrini | |
| 5,123,117 | A * | 6/1992 | Prendergast | 2/108 |
| 5,165,111 | A * | 11/1992 | Lieberman | 2/94 |
| 5,450,627 | A * | 9/1995 | Grilliot et al. | 2/81 |
| 5,526,969 | A * | 6/1996 | Greenberger | 224/153 |
| 5,673,836 | A * | 10/1997 | Bush | 224/576 |
| 5,699,560 | A * | 12/1997 | Greenberg | 2/94 |
| 5,743,448 | A * | 4/1998 | Tsai | 224/153 |
| 5,784,719 | A * | 7/1998 | Robinson | 2/94 |
| D404,539 | S * | 1/1999 | Glasser | D2/831 |
| 5,860,164 | A * | 1/1999 | Johnson | 2/94 |
| 6,073,268 | A * | 6/2000 | Ziegler et al. | 2/94 |
| 6,134,712 | A * | 10/2000 | Spector | 2/94 |
| 6,176,408 | B1 | 1/2001 | Miner et al. | |
| 6,421,834 | B2 * | 7/2002 | Kester | 2/94 |
| 6,852,087 | B1 | 2/2005 | Dainese | |
| 7,165,271 | B2 * | 1/2007 | Elen | 2/85 |
| 2004/0195286 | A1 * | 10/2004 | Greenhalgh et al. | 224/581 |
| 2005/0091724 | A1 * | 5/2005 | Snyder et al. | 2/86 |
| 2008/0127395 | A1 * | 6/2008 | Blauer et al. | 2/87 |

FOREIGN PATENT DOCUMENTS

| | | |
|---|---|---|
| DE | 19 20 004 U | 7/1965 |
| DE | 10 2004 006395 A1 | 8/2005 |

* cited by examiner

*Primary Examiner*—Katherine Moran
*Assistant Examiner*—Richale L Quinn
(74) *Attorney, Agent, or Firm*—Modiano & Partners; Albert Josif; Daniel J. O'Byrne

(57) ABSTRACT

An item of clothing, such as a light jacket, heavy jacket, sports jacket or the like, comprising, at the inside of the back, a fastener for fastening to the upper body of a user which comprises two shoulder straps which are adapted to allow the item of clothing to hang from the upper body when it is not being worn.

19 Claims, 3 Drawing Sheets

ITEM OF CLOTHING SUCH AS A LIGHT JACKET, HEAVY JACKET, SPORTS JACKET OR THE LIKE

The present invention relates to an item of clothing, such as a light jacket, heavy jacket, sports jacket or the like.

The invention can be used conveniently in the field of heavy jackets and sports jackets for motorcyclists, to be used preferably but not exclusively during warm weather periods.

The same invention can be used conveniently with light jackets and heavy jackets of the traditional type, coats, raincoats, both of the long type and of the short type, et cetera.

BACKGROUND OF THE INVENTION

As is known, one of the typical problems linked to clothing for motorcyclists is linked to the use of light and heavy jackets when the weather is warm.

It is in fact advisable for a motorcyclist to always wear an item of clothing, such as a light or heavy or sports jacket, which even in favorable weather conditions protects against the air during travel.

However, especially in the warmest hours of the day, it is often necessary to remove the jacket to avoid overheating the upper body.

The motorcyclist might therefore find himself/herself with both hands busy: one hand holding the helmet and the other holding the jacket.

It is obvious that this situation is particularly awkward, since every time it is necessary to use a hand it is also necessary to transfer the load from one hand to the other or to find a place where to rest the jacket or the helmet, with the risk of forgetting the item once the activity has ended.

The same problem can also occur with ordinary items of clothing, used not only by motorcyclists.

In warm days, when one wishes to remove the jacket to avoid overheating the upper body, the jacket in fact has to be held in one's hand.

This can be awkward, particularly if another item, such as for example a bag, is in the other hand.

SUMMARY OF THE INVENTION

The aim of the present invention is to solve the above mentioned drawbacks linked to items of clothing such as a light jacket, heavy jacket or the like, by providing an item of clothing, such as a light jacket, heavy jacket or sports jacket, which allows to avoid occupying one's hands if it is not being worn.

Within this aim, an object of the present invention is to provide an item of clothing, such as a light jacket, heavy jacket or sports jacket, which is comfortable and safe for use on a motorcycle.

This aim and this and other objects, which will become better apparent hereinafter, are achieved by an item of clothing, such as a light jacket, heavy jacket, sports jacket or the like, characterized in that it comprises, at the inside of the back, means for fastening to the upper body of a user which comprise two shoulder straps which are adapted to allow said item of clothing to hang from said upper body when it is not being worn.

In this manner, at least one hand of the user is free, since it is not occupied by the item of clothing, which in practice hangs from the back of the user.

Advantageously, in a preferred embodiment, the item of clothing comprises means for reversibly fixing said fastening means to said inside of the back.

In this manner, the item of clothing can be separated from the fastening means if, for example, it is believed that they are not necessary at a given time.

In another preferred embodiment, the fastening means comprise a rear supporting part for a back protector, thus providing a substantial advantage in terms of safety if the item is used for motorcycling activities.

Optionally, said rear supporting part for a back protector can be worn separately from the item of clothing, by association with the reversible fixing means.

Moreover, according to another preferred embodiment, the item of clothing comprises a helmet carrying bag which is associated with the back region of said item.

In this manner, the motorcyclist user, in warm periods, has both hands free, since the item of clothing hangs from his/her back and the helmet is embedded in the item of clothing.

BRIEF DESCRIPTION OF THE DRAWINGS

Further characteristics and advantages of the invention will become better apparent from the following detailed description of a preferred but not exclusive embodiment thereof, illustrated by way of non-limiting example in the accompanying drawings, wherein.

DESCRIPTION OF THE PREFERRED EMBODIMENTS

Figure 1:
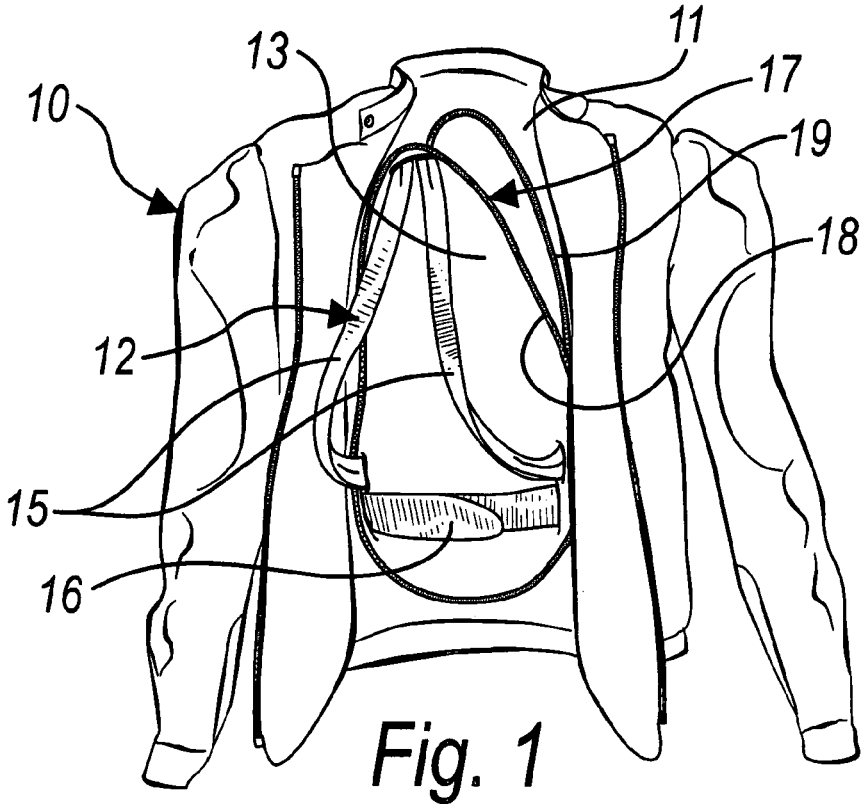
FIG. 1 is a front perspective view of an item of clothing according to the invention, such as a motorcycling jacket, illustrating the fastening means which are partially spaced from the inside of the back of said jacket.
Figure 2:
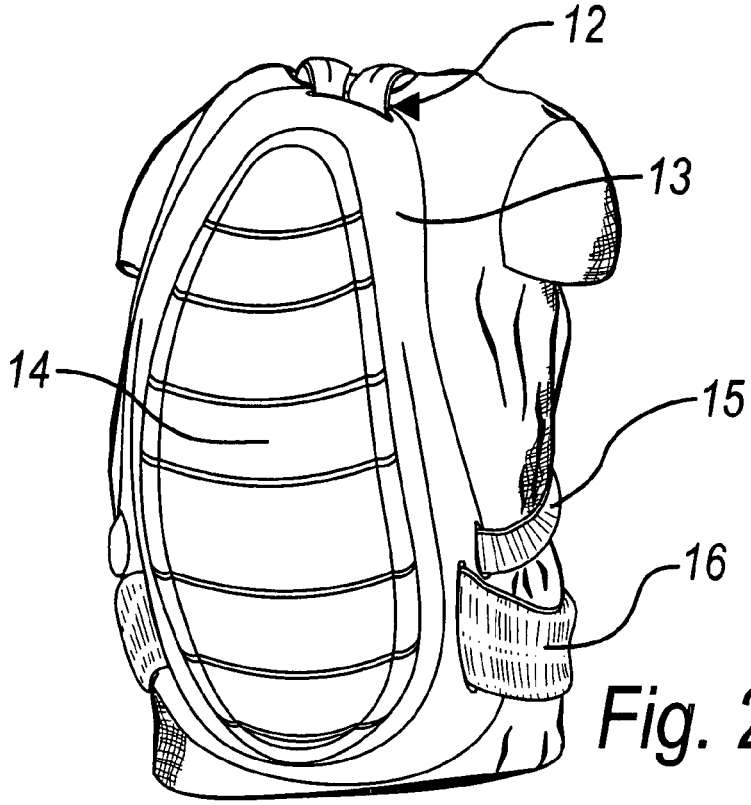
FIG. 2 is a rear perspective view of the item of FIG. 1, illustrating the fastening means with the back protector separated from the rest of the jacket.

It is noted that anything found to be already known during the patenting process is understood not to be claimed and to be the subject of a disclaimer.

With reference to the figures, an item of clothing according to the invention is generally designated by the reference numeral 10.

In this embodiment, the item of clothing is a motorcycling jacket.

The item of clothing 10, which is shaped like a sports jacket, comprises, at the inside of the back 11, means 12 for fastening to the upper body of a user.

In particular, the fastening means 12 comprise a rear part 13 for supporting a back protector 14 and two shoulder straps 15 which extend forward from the rear part 13.

Moreover, the fastening means 12 also comprise a belt portion 16 which extends from the rear part 13 for supporting the back protector 14.

Figure 3:
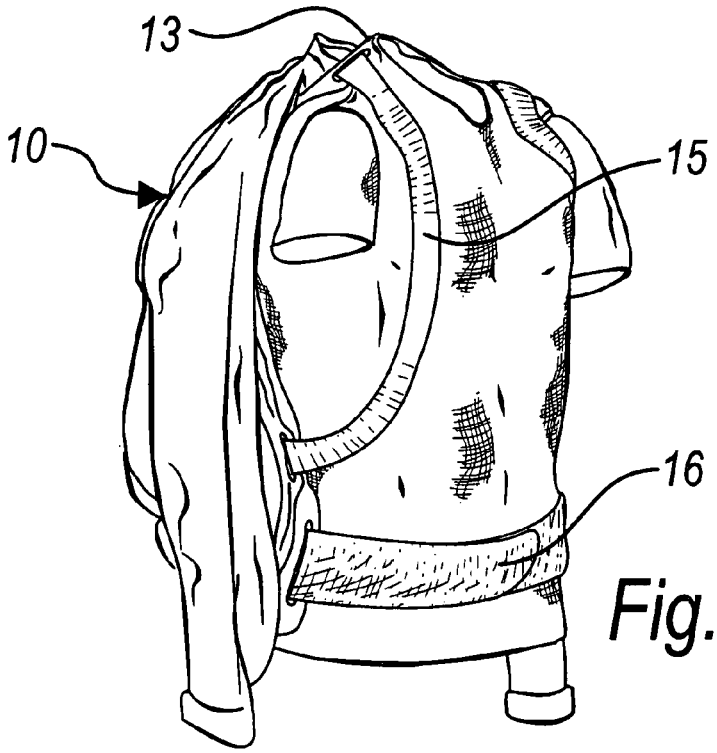
FIG. 3 is a view of the jacket of FIG. 1, hanging from said fastening means.

The pair of shoulder straps 15 allows the jacket to hang from the upper body of the user when it is not being worn, as clearly shown in FIG. 3.

In this embodiment, the invention comprises fixing means 17 for reversibly fixing the fastening means 12 to the inside of the back 11 of the item of clothing.

The reversible fixing means 17 are constituted for example by a zip fastener, in which a first toothed flap 18 is integrated on the rear part 13 so as to surround the back protector 14 and a second toothed flap 19 is integrated, with the same arrangement as the first toothed flap 18, on the inside of the back 11.

Figure 4:
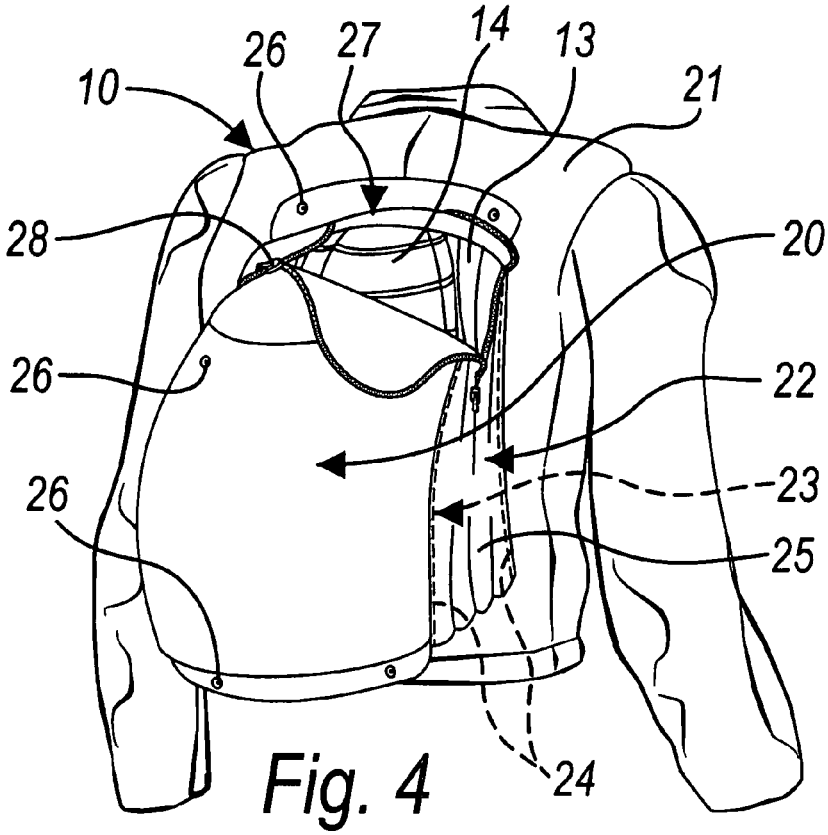
FIG. 4 is a rear perspective view of said jacket, illustrating an open rear bag.

Advantageously, in this embodiment, the item of clothing comprises a helmet bag 20 which is associated with the back region 21 of said item of clothing, as clearly shown in FIG. 4.

For example, the internal volume of the bag 20 is delimited by the rear part 13 for supporting the back protector 14 and by a concertina portion 22 which is integrated in the back region 21 of the item of clothing.

Figure 5:
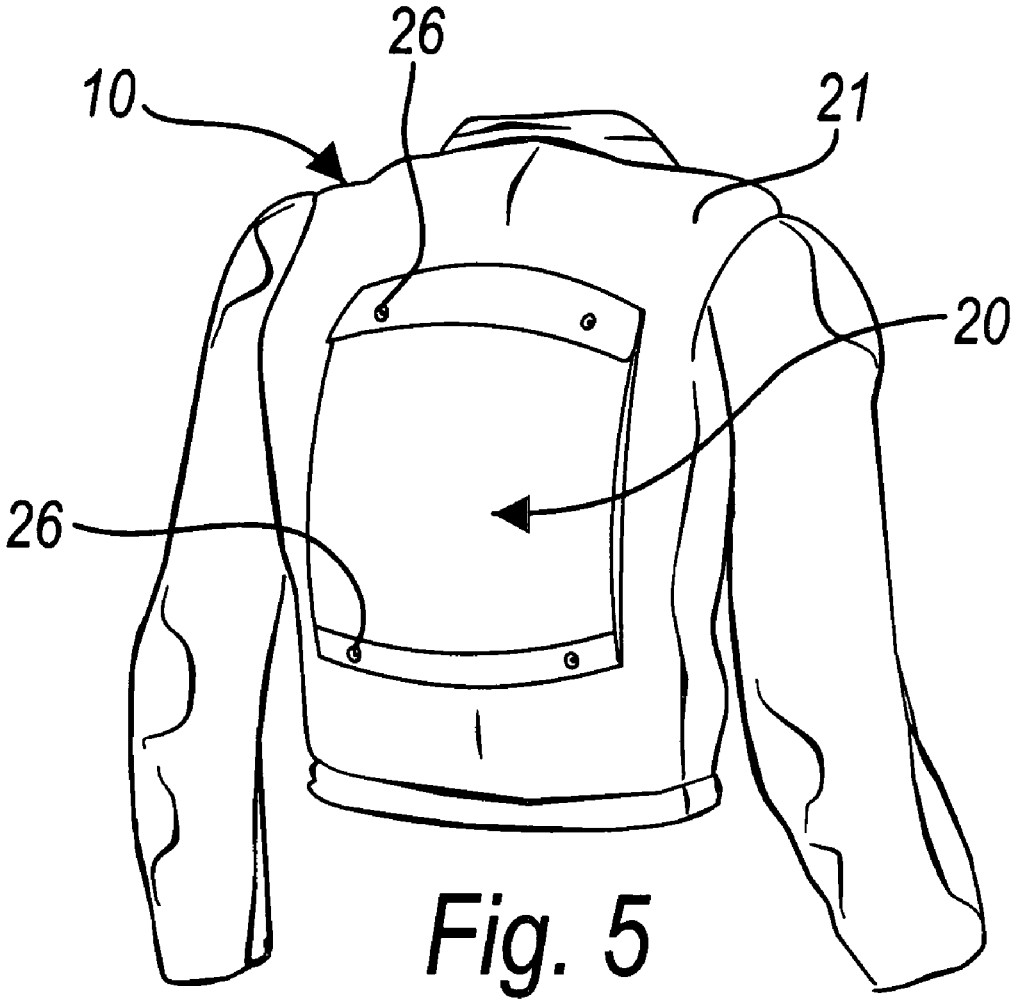
FIG. 5 is a rear perspective View of said jacket, illustrating the bag of FIG. 4 closed in a configuration for minimal space occupation.

Conveniently, keeping means 23 for maintaining the concertina portion 22 in a minimum bulk configuration are provided and are constituted, according to a method of a type which is known in concertina bags, by a zip fastener for joining the mutually opposite substantially vertical ends 24 of lateral portions 25 of the concertina portion 22; FIG. 5 illustrates the configuration of minimum space occupation, with the bag 20 fully flattened onto the back region 21 of the item of clothing and secured thereat by means of press-studs 26.

To allow easy use of the bag 20, said bag comprises in an upper region an opening 27 which is associated with means 28 for quick opening/closure, such as for example a zip fastener.

In practice it has been found that the invention thus described achieves the intended aim and objects.

The present invention in fact provides an item of clothing, such as a light jacket, heavy jacket, sports jacket or the like which can be not worn without occupying one's hands.

This has been achieved in practice by associating with the jacket fastening means which allow to hang said jacket from the upper body when the jacket is not being worn, thus leaving the hands free.

Advantageously, a bag is integrated in the same item of clothing and allows to store the helmet (and obviously also other items), thus allowing to also free the hand assigned to holding the helmet.

Moreover, a back protector can be rigidly associated with the fastening means, thus allowing to increase the safety of the motorcyclist.

The fastening means with the back protector can be separated from the jacket and can also be used individually or with another item of clothing, if necessary.

As already stated, the invention can be applied to light jackets, heavy jacket, sports jackets, for motorcyclists and of the traditional type, and also to coats, raincoats, both of the long type and of the short type, et cetera.

The type of material of the item also can be the most disparate, from waterproof fabric to breathable fabric, windproof fabric, et cetera.

The invention thus conceived is susceptible of numerous modifications and variations, all of which are within the scope of the appended claims; all the details may further be replaced with other technically equivalent elements.

In practice, the materials employed, so long as they are compatible with the specific use, as well as the dimensions, may be any according to requirements and to the state of the art.

The disclosures in Italian Patent Application No. PD2006A000438 from which this application claims priority are incorporated herein by reference.

What is claimed is:

1. A motorcycling jacket comprising:

a rear supporting part that has an inside region and an outside region and that extends at an upper back region and a lower back region;

a remaining jacket part suitable to dress at least the upper body of a user;

two shoulder straps provided at said inside region of said rear supporting part adapted for fastening to the upper body of the user and adapted for allowing the remaining jacket part to hang from the upper body of the user when not dressed;

a motorcycling back protector supported at said outside region of said rear supporting part and extending at said upper and lower back regions;

reversible fixing means for reversibly fixing said remaining jacket part to said rear supporting part such that said rear supporting part, having said two shoulder straps and said motorcycling back protector supported thereby, may be separated completely from said remaining jacket part so as to be used individually, or said rear supporting part may be fixed to said remaining jacket part so as to be used mutually together; and a helmet holding bag which is associated with a back part of said remaining jacket part.

2. The motorcycling jacket of claim 1, comprising a concertina portion which is integrated in the back part of said remaining jacket part, said holding bag enclosing an internal volume that is limited by said rear supporting part and by said concertina portion.

3. The motorcycling jacket of claim 2, further comprising keeping means provided on said concertina portion for keeping the concertina portion in a configuration for minimal space occupation.

4. The motorcycling jacket of claim 3, wherein said keeping means comprise a zip fastener for joining mutually opposite substantially vertical ends of lateral portions of said concertina portion.

5. The motorcycling jacket of claim 1, wherein said helmet holding bag comprises in an upper region thereof an opening which is provided with quick opening and closure means.

6. The motorcycling jacket of claim 5, wherein said quick opening and closing means comprise a zip fastener.

7. The motorcycling jacket of claim 1, wherein said two shoulder straps extend frontally from said rear supporting part for supporting said back protector.

8. The motorcycling jacket of claim 7, further comprising a belt shaped portion, which extends from said rear supporting part for supporting said back protector.

9. The motorcycling jacket of claim 1, wherein said reversible fixing means comprise a zip fastener, a first toothed flap of which is integrated on said rear supporting part so as to surround said back protector and a second toothed flap of which is integrated, with a same shape as said first toothed flap, on an inside region of the back part of the remaining jacket part.

10. A motorcycling jacket comprising:

a rear supporting part that has an inside region and an outside region;

a remaining jacket part suitable to dress at least the upper body of a user;

two shoulder straps provided at said inside region of said rear supporting part adapted for fastening to the upper body of the user and adapted for allowing the remaining jacket part to hang from the upper body of the user when not dressed;

a motorcycling back protector supported at said outside region of said rear supporting part;

reversible fixing means for reversibly fixing said remaining jacket part to said rear supporting part such that said rear supporting part, having said two shoulder straps and said motorcycling back protector supported thereby, may be separated completely from said remaining jacket part so as to be used individually, or said rear supporting part may be fixed to said remaining jacket part so as to be used mutually together;

a helmet holding bag which is associated with a back part of said remaining jacket part; and a concertina portion which is integrated in the back part of said remaining jacket part, said holding bag enclosing an internal volume that is limited by said rear supporting part and by said concertina portion.

11. The motorcycling jacket of claim 10, further comprising keeping means provided on said concertina portion for keeping the concertina portion in a configuration for minimal space occupation.

12. The motorcycling jacket of claim 10, wherein said helmet holding bag comprises in an upper region thereof an opening which is provided with quick opening and closure means.

13. The motorcycling jacket of claim 10, wherein said two shoulder straps extend frontally from said rear supporting part for supporting said back protector, and the jacket further comprising a belt shaped portion, which extends from said rear supporting part for supporting said back protector.

14. The motorcycling jacket of claim 10, wherein said reversible fixing means comprise a zip fastener, a first toothed flap of which is integrated on said rear supporting part so as to surround said back protector and a second toothed flap of which is integrated, with a same shape as said first toothed flap, on an inside region of the back part of the remaining jacket part.

15. A motorcycling jacket comprising:

a rear supporting part that has an inside region and an outside region;

a remaining jacket part suitable to dress at least the upper body of a user, two shoulder straps provided at said inside region of said rear supporting part adapted for fastening to the upper body of the user and adapted for allowing the remaining jacket part to hang from the upper body of the user when not dressed;

a motorcycling back protector supported at said outside region of said rear supporting part; and reversible fixing means for reversibly fixing said remaining jacket part to said rear supporting part such that said rear supporting part, having said two shoulder straps and said motorcycling back protector supported thereby, may be separated completely from said remaining jacket part so as to be used individually, or said rear supporting part may be fixed to said remaining jacket part so as to be used mutually together;

said reversible fixing means comprising a zip fastener, a first toothed flap of which is integrated on said rear supporting part so as to surround said back protector and a second toothed flap of which is integrated, with a same shape as said first toothed flap, on an inside region of the back part of the remaining jacket part.

16. The motorcycling jacket of claim 15, further comprising a helmet holding bag which is associated with a back part of said remaining jacket part.

17. The motorcycling jacket of claim 16, wherein said helmet holding bag comprises in an upper region thereof an opening which is provided with quick opening and closure means.

18. The motorcycling jacket of claim 15, further comprising keeping means provided on said concertina portion for keeping the concertina portion in a configuration for minimal space occupation.

19. The motorcycling jacket of claim 15, wherein said two shoulder straps extend frontally from said rear supporting part for supporting said back protector, and the jacket further comprising a belt shaped portion, which extends from said rear supporting part for supporting said back protector.

* * * * *